United States Patent [19]

Nishikawa et al.

[11] 4,200,847

[45] Apr. 29, 1980

[54] RECTANGULAR BRANCHING FILTER HAVING PLURALITY OF ROD MEMBERS FOR FINE IMPEDANCE MATCHING

[75] Inventors: Toshio Nishikawa, Nagaokakyo; Yoji Ito, Takatsuki; Youhei Ishikawa; Sadahiro Tamura, both of Kyoto, all of Japan

[73] Assignee: Murata Manufacturing Co., Ltd., Nagaokakyo, Japan

[21] Appl. No.: 836,902

[22] Filed: Sep. 26, 1977

[30] Foreign Application Priority Data

Oct. 4, 1976 [JP] Japan ..... 51-133834

[51] Int. Cl.[2] ..... H01P 5/12

[52] U.S. Cl. ..... 333/125; 333/126

[58] Field of Search ..... 333/1.1, 9, 33, 11, 333/122, 125, 126

[56] References Cited

U.S. PATENT DOCUMENTS

| | | | |
|---|---|---|---|
| 2,584,162 | 2/1952 | Sensiper et al. | 333/9 |
| 2,590,373 | 3/1952 | Bradley | 333/9 X |
| 2,801,390 | 7/1957 | Dairiki et al. | 333/9 |
| 3,493,896 | 2/1970 | Buchta | 333/1.1 |

FOREIGN PATENT DOCUMENTS

| | | | |
|---|---|---|---|
| 870873 | 6/1961 | United Kingdom | 333/9 |

*Primary Examiner*—Paul L. Gensler

*Attorney, Agent, or Firm*—Wenderoth, Lind & Ponack

[57] ABSTRACT

A T-shaped rectangular waveguide branching filter includes an electrically conductive projection or protrusion of approximately triangular cross section which is formed at a predetermined portion within the branching filter for preliminary impedance matching of a predetermined accuracy as observed from each of the input/output ports of the branching filter, and an electrically conductive rod which may be selectively advanced toward or retracted from the first input/output port and extends through the electrically conductive protrusion of triangular cross section so that, by selectively advancing or retracting the conductive rod, a particular impedance match corresponding to each of the input/output ports as observed from any one of the input/output ports may be achieved for efficiently deriving the signal applied to one of the input/output ports from either one of the other input/output ports.

1 Claim, 5 Drawing Figures

RECTANGULAR BRANCHING FILTER HAVING PLURALITY OF ROD MEMBERS FOR FINE IMPEDANCE MATCHING

The present invention relates to an electrical branching filter and more particularly, to a rectangular waveguide branching filter which may be adjusted for perfect impedance matching with respect to any one of its input/output ports.

In general, an electrical branching filter, especially a rectangular waveguide branching filter which is arranged to couple a signal applied to one of its input/output ports to either one of its other input/output ports, has been widely employed for a variety of purposes in electrical and electronic equipment, for example, electronic communication and control equipment.

Figure 1:
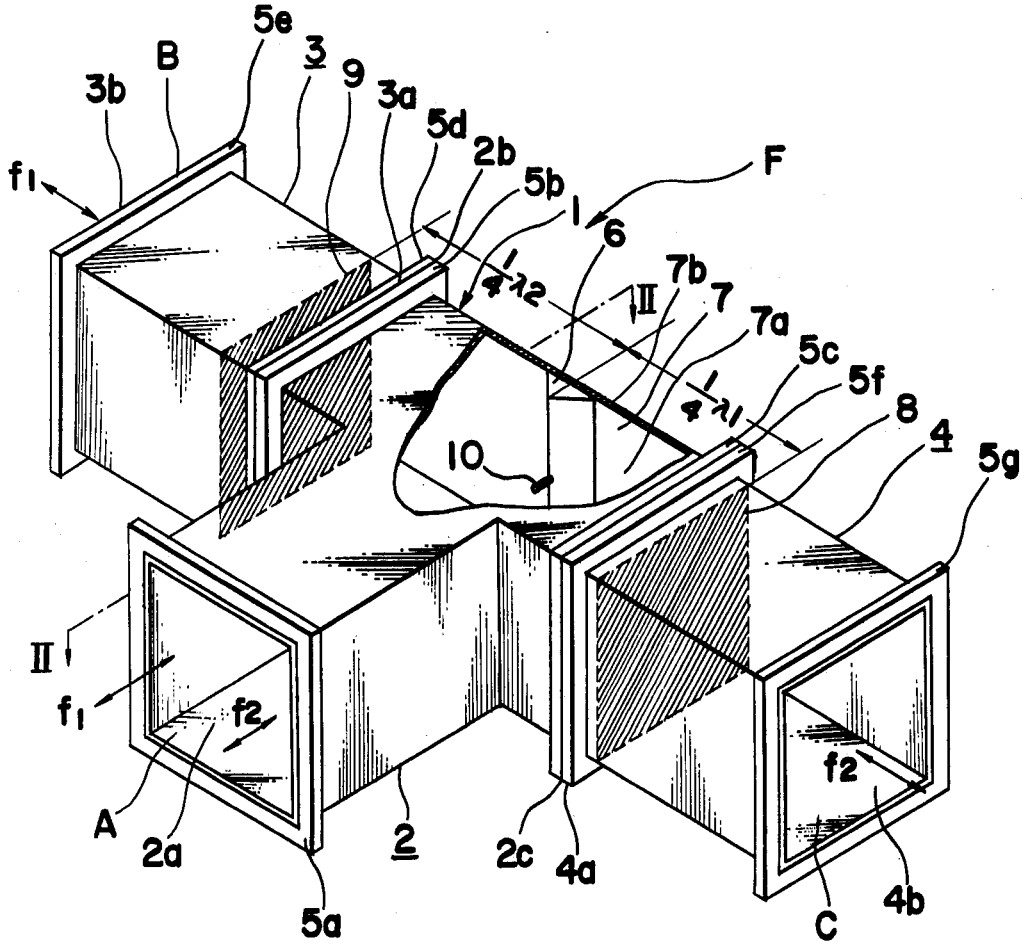

Conventionally, as one example of the rectangular waveguide branching filter of the above described type, there has been disclosed as prior art, for example, in FIG. 1 of Japanese Utility Model publication Jitsukaisho No. 9143/49, a T junction type rectangular waveguide branching filter including a first input/output port, second and third input/output ports, aligned in a straight line and intersecting for continuation at right angles with the first input/output port, and electrically conductive protrusion of approximately triangular cross section formed within the branching filter aligned parallel to the height of said branching filter at a central portion of the wall connecting said second and third input/output ports and facing said first input/output port.

The known rectangular waveguide branching filter as described above has serious disadvantages in that, partly due to the difficulty of maintaining accuracy in producing the branching filter and triangular protrusion, the actual working characteristic values in matching impedances tend to deviate in matching impedances from theoretical values, thus it being impossible to efficiently derive a desired input signal therefrom or to make proper adjustments to offset this a deviation from the structural point of view.

Accordingly, an essential object of the present invention is to provide a T-shape rectangular waveguide branching filter which is capable of deriving a signal applied to one of its input/output ports, from either one of its other input/output ports in an efficient manner, with substantial elimination of the disadvantages inherent in the conventional rectangular waveguide branching filters.

Another important object of the present invention is to provide a rectangular waveguide branching filter of the above described type in which deviation in impedance matching due to problems in processing accuracy of the branching filter may be readily corrected by a simple arrangement for precise impedance matching at a high accuracy.

A further object of the present invention is to provide a rectangular waveguide branching filter of the above described type which is compact in size and can be readily incorporated into various types of electrical and electronic equipment at low cost.

In accomplishing these and other objects, according to the present invention, the T-shaped rectangular waveguide branching filter includes an electrically conductive projection or protrusion of approximately triangular cross section which is formed at a predetermined portion within said branching filter for preliminary impedance matching of a predetermined accuracy as observed from each of input/output ports of the branching filter, while an electrically conductive rod which may be selectively advanced toward or retracted from the first input/output port is provided to extend through said protrusion of triangular cross section so that, by selectively advancing or retracting the conductive rod, a particular impedance match corresponding to each of the input/output ports as observed from any one of said input/output ports is achieved for efficiently deriving the signal applied to one of the input/output ports from either one of the other input and output ports. By the simple construction described above, an efficient rectangular waveguide branching filter of compact size has been advantageously presented.

Figure 2:
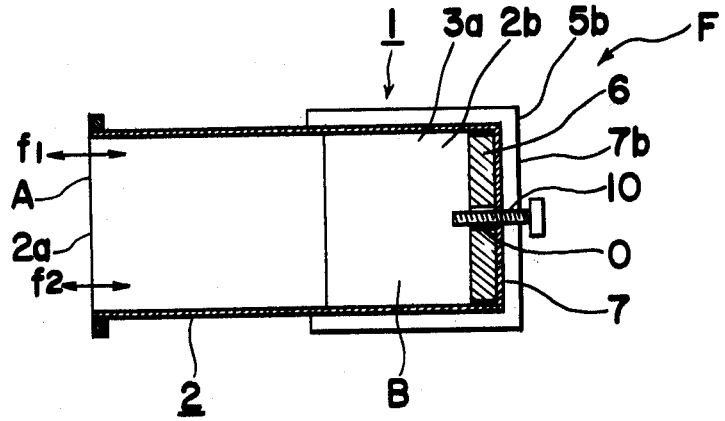
Figure 3:
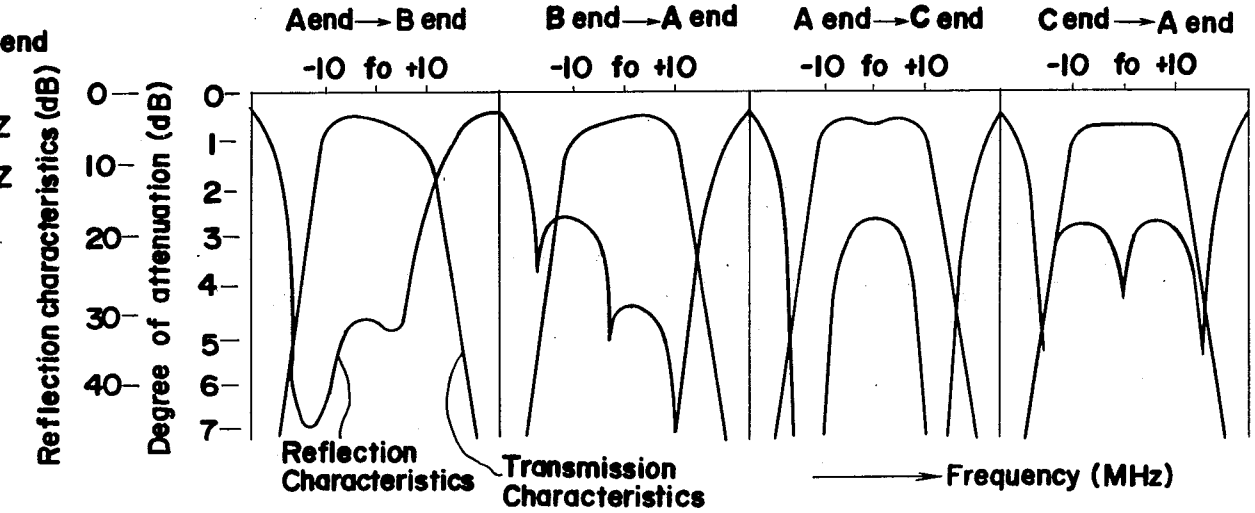
FIG. 3 Prior Art
Figure 4:
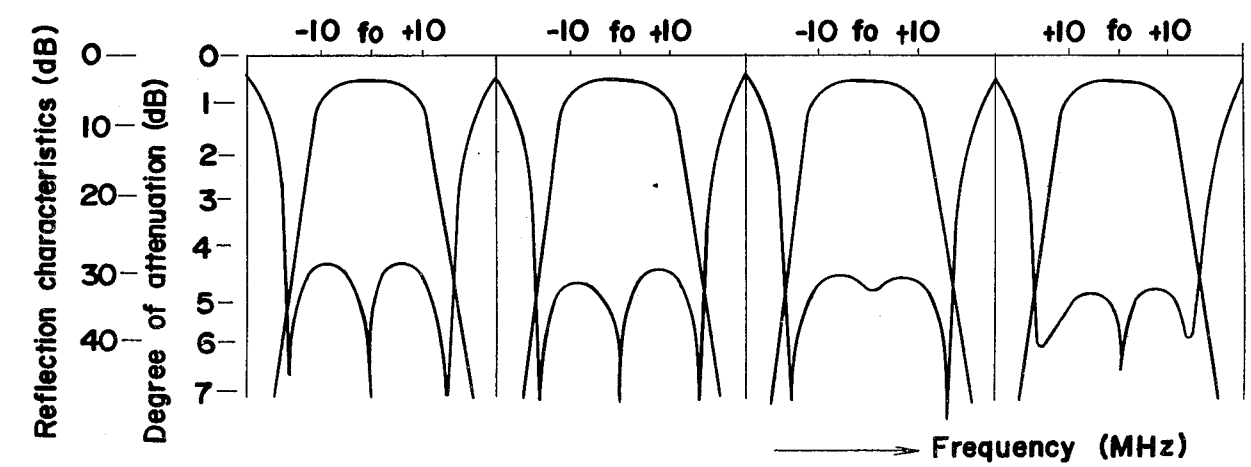

These and other objects and features of the present invention will become apparent from the following description taken in conjunction with the preferred embodiment thereof with reference to the accompanying drawings in which, FIG. 1 is a perspective view, partly in section, of a rectangular waveguide branching filter according to one preferred embodiment of the present invention, FIG. 2 is a cross sectional view taken along the line II—II of FIG. 1, FIG. 3 is a graph showing the transmission characteristics and the reflection characteristics between respective input/and output ports of a conventional rectangular waveguide branching filter without an electrically conductive rod for impedance matching, and FIG. 4 is a graph showing the transmission characteristics and the reflection characteristics between respective input/output ports of the rectangular waveguide branching filter of FIG. 1 according to the present invention provided with an electrically conductive rod for the impedance matching.

Figure 5:
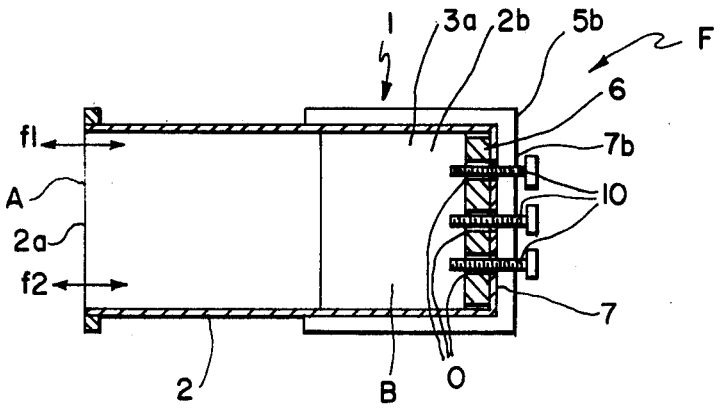

FIG. 5 is a cross sectional view similar to FIG. 2, illustrating an embodiment having a plurality of rod members.

Before the description of the present invention proceeds, note that like parts are designated by like reference numerals throughout views of the accompanying drawings.

Referring now to the drawings, there is shown in FIG. 1 a rectangular waveguide branching filter F of approximately T shape according to one preferred embodiment of the present invention. The rectangular waveguide filter F is intended to separate signals having frequencies, for example, frequencies f1 and f2, and chiefly comprises a main structure 1 which includes an approximately T-shaped waveguide 2 having three rectangular opening planes 2*a*, 2*b* and 2*c* respectively defined by corresponding flanged ends 5*a*, 5*b* and 5*c* of the waveguide 2, with the opening plane 2*a* serving as an input/output port A for the branching filter F, and waveguide type filters 3 and 4 respectively having, at their opposite ends, rectangular opening planes 3*a* and 3*b*, and 4*a* and 4*b* defined by corresponding flanged ends 5*d* and 5*e*, and 5*f* and 5*g* of similar configuration and dimensions to the flanged ends 5*b* and 5*c* of the waveguide 2. The waveguide type filters 3 and 4 are aligned in a straight line which intersects at right angles with a line perpendicular to the opening plane 2*a* of the waveguide 2 and are suitably coupled for communication at the opening planes 3*a* and 4*a* thereof with the opening planes 2*b* and 2*c* of the T-shaped waveguide 2 through the flanged ends 5*d* and 5*b*, and 5*c* and 5*f* respectively, with the other opening planes 3*b* and 4*b* of the filters 3 and 4 serving as input/output ports B and C of the rectangular waveguide branching filter F.

Note that the waveguide type filters 3 and 4 function as band-pass filters for passing therethrough the frequencies f1 and f2 respectively. These band-pass filters may be constituted by conventional resonators such as cavity resonators and the like, but should preferably be formed by dielectric resonators for reduction of size and cost.

Referring also to FIG. 2, the rectangular waveguide branching filter F further inlcudes a projection or protrusion 6 of electrically conductive material for impedance matching having an approximately triangular cross section and formed within said waveguide 2 aligned with the height of the waveguide 2 or the branching filter F at a predetermined position on an inner surface 7*a* of the wall 7 of the T-shaped waveguide 2 which connects the waveguide type filters 3 and 4. The protrusion 6 of triangular cross section has a height approximately equal to that of the waveguide 2, while the width and the height of the apex of the triangular protrusion 6 are determined so that the impedances as observed from each of the input/output ports A, B and C of the rectangular waveguide branching filter 1, i.e., the respective receiving-end impedances for the T-shaped waveguide 2 and the waveguide type filters 3 and 4 are approximately matched with the characteristic impedance of the duct lines. Note that the protrusion 6 described above may be integrally formed with the wall 7, or may be separately formed and rigidly secured to the wall 7. When an input signal having frequencies f1 and f2 is applied, for example, to the input/output port A, the signal having the frequency f1 is to be taken out from the input/output port B, and the signal having the frequency f2 is to be taken out from the input/output port C, with guide wavelength or wavelength in the waveguide of the respective signals being represented by the symbols $\lambda_1$ and $\lambda_2$, the protrusion 6 is located at a position $((2n-1)/4)\lambda_1$, where n is a positive integer, (for example, in the embodiment of FIG. 1, the odd number is equivalent to one) from a short-circuit plane 8 for the waveguide type filter 4 and also $((2m-1)/4)\lambda_2$, where m is a positive integer, from a short-circuit plane 9 for the waveguide type filter 3, i.e., on an opening plane with respect to the short-circuit planes 8 and 9. The branching filter F is further provided with an electrically conductive rod 10 for fine impedance matching adjustment which is threadedly received by an internally threaded opening O formed in the protrusion 6 for selective insertion into or withdrawal from the waveguide 2. The conductive rod 10 extends from an outer surface 7*b* of the wall 7 through an intermediate portion on a central axis parallel to the height of the protrusion 6, i.e., through the apex of said protrusion 6, toward the opening plane 2*a* of the waveguide 2 so that the degree of the impedance matching is varied according to the projected length of the conductive rod 10 in the waveguide 2.

In the above arrangement, when a signal having the frequency f1 is applied to the input/output port A, the signal advances toward the respective input sides of the waveguide type filters 3 and 4, while propagating along the interior of the waveguide 2. In this case, theoretically, since the impedances are preliminarily matched by the protrusion 6 of triangular cross section, there is no standing wave developed, and the signal propagated toward the side of the waveguide type filter 3 is derived as it is in the form of an output signal through the input/output port B, while the signal propagated toward the side of the waveguide type filter 4 is also perfectly or totally reflected by the short-circuit plane 8 to ride over the signal propagated to the side of the waveguide filter 3 and is to be derived from the input/output port B as an output signal.

Subsequently, when a signal having a frequency, for example, frequency f2 is applied to the input/output port A, this signal is propagated to the waveguide type filters 3 and 4 while propagating along the interior of the waveguide 2, and the signal propagated to the side of the waveguide type filter 4 is derived as an output through the input/output port C in the similar manner as described above, while the signal propagated to the waveguide type filter 3 is to be totally reflected by the short circuit plane 9.

Note that in the above case, when the rectangular waveguide branching filter F is actually produced, perfect matching is difficult to achieve by the provision of only the triangular protrusion 6, with a satisfactory voltage standing wave ratio (V.S.W.R.) at the frequencies f1 and f2 not being achieved.

Accordingly, in the rectangular waveguide branching filter F of the invention, the imperfect matching by the protrusion 6 alone is further adjusted by the selective insertion or withdrawal of the conductive rod 10 with respect to the opening plane 2*a* of the waveguide 2. By the above adjustment, impedance matching of the frequencies f1 and f2 with respect to the input signal is achieved simultaneously, and the signals subjected to the total reflection by the short-circuit planes 8 or 9 rides over the corresponding signal propagated to the side of the waveguide type filter 3 or 4 so as to be derived from the input/output port B or C.

The graph of FIG. 3 shows the transmission characteristics and reflection characteristics between the input/output ports in a conventional arrangement without the conductive rod 10, and the graph of FIG. 4 shows similar characteristics between the input/output ports A, B and C in the arrangement according to the present invention provided with the conductive rod 10. By the adjustment of the conductive rod 10 in the manner as described with reference to FIGS. 1 and 2, the reflection characteristics are particularly improved.

Note that, in the foregoing embodiment, although only one conductive rod 10 is employed, the number of conductive rods 10 is not limited to one, but a plurality of such conductive rods may be provided each extending through the protrusion and projecting from the apex toward the first input/output port such as illustrated in FIG. 5, depending on necessity.

Note that the conductive rod 10 described as threadedly received in the protrusion 6 of triangular cross section for selective insertion into or withdrawl from the branching filter 1 may be modified to be received in the protrusion 6 by any other means, for example, through sliding engagement with the protrusion 6, so long as the conductive rod 10 is arranged to be movable toward or away from the opening plane 2*a* of the waveguide 2 for the proper impedance matching adjustment.

As is clear from the foregoing description, according to the present invention, the branching filter having the protrusion of triangular cross section which is provided in the rectangular waveguide and whose dimensions are predetermined to correspond to the input frequencies is further provided with an electrically conductive rod which is received in the triangular protrusion so as to be selectively inserted or withdrawn with respect to the corresponding opening plane of the T-shaped waveguide for adjusting the deviation in matching due to the manufacturing inaccuracy inherent in the protrusion and branching filter, and therefore, impedance matching of high accuracy can be achieved according to the conditions of use for the branching filter through simple operation, while the voltage standing wave ratio can be brought to a value close to an ideal value.

Although the present invention has been fully described by way of example with reference to the attached drawings, note that various changes and modifications are apparent to those skilled in the art. Therefore, unless these changes and modifications otherwise depart from the scope of the present invention, they should be construed as included therein.

What is claimed is:

1. A T-shape rectangular waveguide branching filter comprising:

a main structure having first, second and third input/output ports, a first rectangular waveguide section connecting said second and third input/output ports in a straight line and a second rectangular waveguide section connected to said first input/output port and intersecting said first rectangular waveguide section at a right angle;

a protrusion of an electrically conducting material having a triangular cross section, said protrusion aligned perpendicular to the plane of the longitudinal axes of said first and second rectangular waveguide sections and disposed within said main structure at a central portion of the wall of said first rectangular waveguide section opposite the intersection with said second rectangular waveguide section for confronting said first input/output port and for preliminary impedance matching of a predetermined accuracy with respect to said first, second and third input/output ports; and a plurality of rod members of electrically conductive material extending through said protrusion to project from the apex portion of said protrusion toward said first input/output port for selective movement toward and away from said first input/output port for fine impedance matching with respect to said first, second and third input/output ports.

* * * * *